United States Patent [19]

Ikechi et al.

[11] 4,001,857

[45] Jan. 4, 1977

[54] DEVELOPING DEVICE

[75] Inventors: Masai Ikechi; Kuniyuki Kusano, both of Tokyo, Japan

[73] Assignee: Fuji Photo Film Co., Ltd., Minami-ashigara, Japan

[22] Filed: Feb. 3, 1975

[21] Appl. No.: 546,764

[30] Foreign Application Priority Data

Feb. 4, 1974 Japan ..... 49-14586[U]

[52] U.S. Cl. ..... 354/337; 134/143; 134/149; 354/313; 354/323

[51] Int. Cl.[2] ..... G03D 13/02

[58] Field of Search ..... 354/297, 311, 312, 313, 354/316, 323, 331, 307, 333, 336, 337, 338; 134/143, 149, 158

[56] References Cited

UNITED STATES PATENTS

| | | | |
|---|---|---|---|
| 810,234 | 1/1906 | Towers et al. | 354/323 X |
| 1,395,160 | 10/1921 | Stockwell | 354/313 |
| 2,112,605 | 3/1938 | Pless | 354/313 |
| 2,212,357 | 8/1940 | Vanderwalker | 354/311 |
| 2,522,763 | 9/1950 | Powell | 354/307 X |
| 2,530,734 | 11/1950 | Salzman | 354/313 |
| 3,276,346 | 10/1966 | Conway et al. | 354/297 |
| 3,623,416 | 11/1971 | Anderberg | 354/313 X |

*Primary Examiner*—Fred L. Braun
*Attorney, Agent, or Firm*—Gerald J. Ferguson, Jr.; Joseph J. Baker

[57] ABSTRACT

A developing device for developing a film in a film magazine wound on a film spool by rotating the spool is constituted of a developing tank body to receive the film and a developer liquid therein and a handle to rotate the spool. The tank body is provided on the inner surface thereof with a plurality of protrusions or a recess to be engaged with the film outlet of the film magazine to prevent the film magazine from being rotated therein. The handle has a forked portion to be engaged with the engaging portion of the film spool and a radially extending arm portion having a grip at the outer end thereof to be rotated by hand. The handle is rotatably or fixedly mounted to a cover member mounted on the top of the tank body. The cover member on which the handle is rotatably mounted is fixed to the upper end of the tank body. The cover member to which the handle is fixedly mounted is loosely mounted on the upper end of the tank body.

13 Claims, 4 Drawing Figures

DEVELOPING DEVICE

BACKGROUND OF THE INVENTION

1. Field of the Invention

This invention relates to a developing device, and more particularly to a developing device of simple construction for developing an exposed film loaded in a film magazine.

2. Description of the Prior Art

It has been known in the art to develop an exposed film for still cameras while the film is loaded in the film magazine. Some examples of such a simple developing device are disclosed in Japanese Patent Laid-open Nos. 95835/1973 and 3986/1967.

In this type of developing device, the film magazine in which the film is fully taken up on the film wind-back spool after all frames of the film have been exposed is dipped in a developer liquid and the film wind-back spool is rotated back and forth to develop the film.

In the development process by use of this type of developing device, the film wind-back spool must be continuously rotated back and forth at a substantial speed so that the developer liquid sufficiently circulates in the film magazine and uniformly contact the whole surface of the film to produce uniform development. Further, the rotation of the film wind-back spool must be continued for at least a few minutes. According to experiments by the inventors, it takes about three minutes for development and 3 or 4 minutes for fixing, the spool must be rotated at a speed of at least one revolution per second.

In the conventional developing device of the above described type, a rotating rod which has a forked end to be engaged with the engaging portion of the film wind-back spool within the spool shaft is used for rotating the spool. It is, however, difficult to continuously rotate the spool for a long time by use of this sort of rotating rod. For instance, in primary schools and junior high schools in which this type of developing device is particularly appreciated as a teaching device, the strength of the children's fingers is not sufficient to achieve smooth rotation of the rotating rod and there is a high probability of resulting uneven development. According to tests by the inventors in which films were developed by 50 junior high school students by use of the above described type of simple developing devices, about 30% of the films were unevenly developed. About a half of the films unevenly developed were almost useless.

The reason for the above test results is believed to be that the developer liquid was not uniformly stirred because of insufficient rotation speed and shortness of rotation time. As a result the developer liquid was not sufficiently circulated in the film magazine and therefore did not come into uniform contact with the surface of the film.

Further, in the above mentioned type of development devices, it has been proved desirable to rotate the film wind-back spool ten to twenty times in the direction to tighten the film wound thereon and then several times in the direction to loosen the film wound thereon. Since the rotation of the spool in the direction to loosen the film is precluded by the film expanding in the film magazine, the film wind-back spool is mainly rotated in the direction to tighten the film to perform the development. On the other hand, since the right hand is usually used to rotate the spool and accordingly it is easier to rotate the spool clockwise, the film magazine should preferably be supported in such an orientation that the direction of the spool rotation to tighten the film becomes clockwise. The ordinary cylindrical film magazine which is popular in still cameras has a film wind-back spool one end of which is projected out of one end of the film magazine. The projected end of the spool in the film magazine is usually projected out of the lower end of the film magazine when the film magazine is put in the left side of the camera with the back cover opened and the film is pulled out of the film magazine and engaged with a film take-up spool in the camera located on the right side of the camera. Therefore, the film magazine should preferably be supported with the projected end of the spool directed downward in order that the direction of the spool rotation to tighten the film may become clockwise to make it is easy for the right hand to rotate the spool.

In the conventional developing device, however, if the film magazine is put into the developing tank with the projected end of the spool directed downward (as shown in FIG. 1 of Japanese Patent Publication No. 11433/1966), the developer liquid around the projected spool is not made use of for development, which is economically disadvantageous.

SUMMARY OF THE INVENTION

In view of the above described observations and description, it is the primary object of the present invention to provide a developing device for developing a film while the film is loaded in a film magazine by rotating the film wind-back spool in the film magazine in which the spool of the film magazine can easily be rotated so that the developer liquid may be sufficiently stirred and accordingly brought into uniform contact with the surface of the film.

Another object of the present invention is to provide a developing device for developing a film while the film is loaded in a film magazine by rotating the film wind-back spool in the film magazine in which the developing liquid is efficiently made use of for development even when the projected spool end is directed downward.

Still another object of the present invention is to provide a developing device for developing a film while the film is loaded in a film magazine by rotating the film wind-back spool in the film magazine in which the spool is smoothly rotated.

The developing device in accordance with the present invention comprises a development tank body and a cover member with a handle to rotate the film wind-back spool in the film magazine. By use of the handle to rotate the spool, the spool can easily be rotated continuously at a high speed. Further, the development tank is provided with a recess at the center of the bottom thereof to receive the projected end of the spool of the film magazine so that no space is formed around the projected end of the spool and the developer liquid is used efficiently.

The recess formed at the center of the bottom of the development tank also serves as a bearing to support the projected end of the spool and prevent the film magazine from shaking while the spool is rotated.

PREFERRED EMBODIMENTS OF the INVENTION

Figure 2:
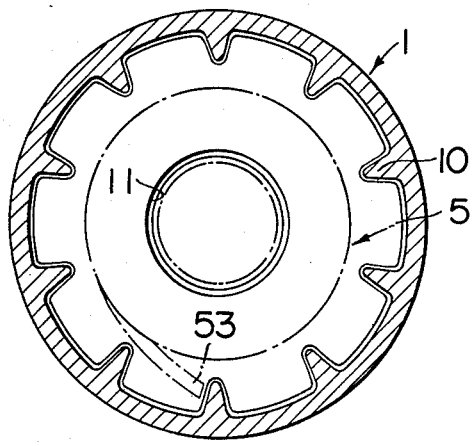
FIG. 2 is a horizontal sectional view of the developing device as shown in FIG. 1 taken along the line II—II.
Figure 1:
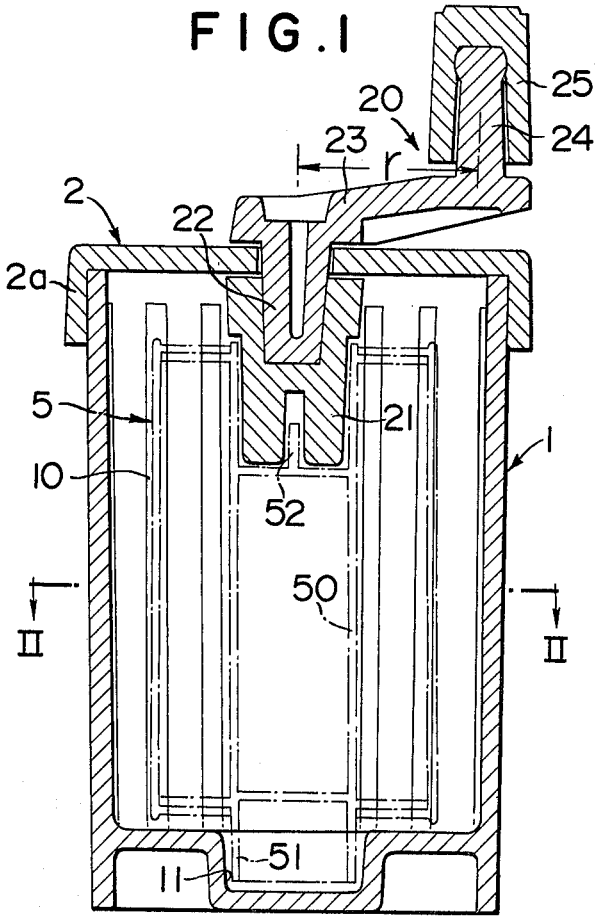
FIG. 1 is a vertical sectional view of one embodiment of the developing device in accordance with the present invention.

Referring to FIGS. 1 and 2 which show a first embodiment of the present invention, a developing tank body 1 and a cover member 2 capped thereon constitute a developing device. The developing tank body 1 is a cylindrical body having a bottom and an open upper end. The inner surface of the developing tank body 1 is provided with a plurality of vertically extending protrusions 10 for preventing the rotation of the film magazine therein. The bottom of the tank body 1 is provided at the center thereof with a recess 11 for receiving the projected end 51 of the film wind-back spool 50 of the film magazine 5. The cover member 2 is provided at the center thereof with a rotatable handle 20 which has at the lower end thereof a forked portion 21 to be engaged with the engaging portion 52 of the spool 50 within the spool shaft thereof, and fixedly mounted to the top end of the tank body 1.

The tank body 1 is made of (preferably transparent) plastic molded in a cylindrical form. Said vertical protrusions 10 are integrally molded with the tank body 1 on the inner surface thereof and extend vertically in parallel of each other. The radial height of the protrusions 10 is sufficiently large to be engaged with the film outlet 53 of the film magazine 5. Said recess 11 is deep enough to receive the substantial part of the projected end 51 of the spool 50 and the internal diameter thereof is substantially equal to or slightly larger than the external diameter of the projected end 51 of the spool 50.

Said cover member 2 is tightly capped on the open end of the tank body 1 so that the cover member 2 will not be rotated when the handle 20 rotatably mounted thereon is rotated. The cover member 2 is also made of plastic and is resiliently fixed to the tank member 1 by the elasticity thereof. The cover member 2 is provided at the marginal part thereof with an annular portion 2*a* extending downward and tightly fixed on the outer surface of the upper end of the tank body 1. Further, the cover member 2 is provided at the central part thereof with a hole in which the rotatable shaft 22 of said handle 20 is rotatably mounted.

The handle 20 comprises said shaft 22, said forked portion 21 fixed to the lower end of the shaft 22, a radially extending arm 23 integrally fixed to the upper end of the shaft 22, a grip support shaft 24 integrally fixed to the upper surface of the outer end of said arm 23 and vertically extending upward, and a grip 25 rotatably mounted on the grip support shaft 24. The radial length *r* of the arm 23 is so determined that the arm can easily be rotated. According to tests by the inventors, the radial length *r* should preferably be about 1.5 to 2.0cm.

When the developing device in accordance with the above described embodiment of the invention is used, the film magazine 5 in which the film is fully rolled up on the film wind-back spool 50 is put into the developing tank body 1 in which a developer liquid is contained. The film outlet 53 of the film magazine 5 is inserted between the vertical protrusions 10 and the downwardly projected end 51 of the spool 50 is received in the recess 11 at the bottom of the tank body 1. Then, the cover member 2 is fixedly mounted on the open upper end of the tank body 1 so that the forked portion 21 of the handle 20 mounted to the cover member 2 is engaged with the engaging portion 52 of the spool 50 of the film magazine 5 in the tank body 1. The tank body 1 is held by the left hand and the handle 20 is rotated by the right hand to rotate the spool 50 in the film magazine.

Thus, the spool 50 is easily and smoothly rotated, particularly in the clockwise direction. Therefore, the required number of revolutions of the spool can easily be obtained. Further, since the rotation of the spool can be continued for a long time without fatigue, the film can easily be developed uniformly.

According to the test by the inventors of the above embodiment of the invention with said fifty junior high school students, none of the films were unevenly developed by the developing device in accordance with the present invention.

Figure 4:
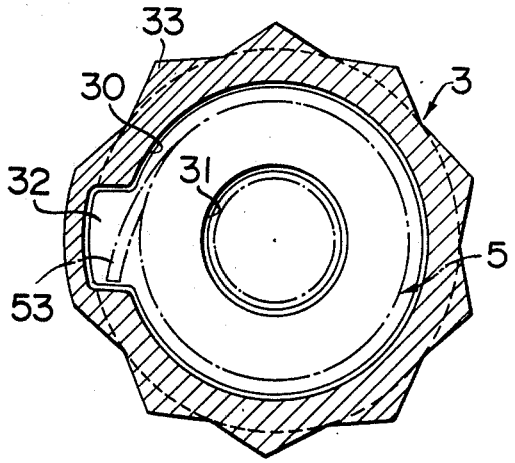
FIG. 4 is a horizontal sectional view of the developing device as shown in FIG. 3 taken along the line IV—IV.

Now a second embodiment of the present invention will be described referring to FIGS. 3 and 4 in which the film magazine and various parts thereof are designated with the same reference numerals as those used in FIGS. 1 and 2. In this second embodiment, the smooth cylindrical inner surface 30 of the tank body 3 is not provided with a vertical protrusion, but provided with a vertically extending groove or recess 32 to be engaged with the film outlet 53 of the film magazine 5 to prevent the rotation of the film magazine 5. The bottom of the tank body 1 is provided at the center thereof with a recess 31 to receive the downwardly projected end 51 of the film wind-back spool 50 similarly to the first embodiment. The outer surface 33 of the cylindrical portion of the tank body 3 is formed to have vertically extending protrusions as shown in FIG. 4 so that the tank body 3 may not be easily rotated by one hand.

The cover member 4 of the second embodiment of the invention comprises a handle portion 40*a* corresponding to the handle 20 of the first embodiment and a cover portion 40*b* corresponding to the cover member 2 of the first embodiment. The handle portion 40*a* and the cover portion 40*b* are integrally fixed to each other and molded together in a piece. The cover portion 40*b* of the cover member 4 is loosely mounted on the top open end of the tank body 3 and rotated thereon together with the handle portion 40*a*.

The handle portion 40*a* comprises a forked portion 41 to be engaged with the engaging portion 52 of the spool 50 of the film magazine 5, a connecting portion 42 extending downward from the central part of the cover portion 40*b* and fixed to the forked portion 41, an arm portion 43 radially extending outward from the connecting portion 42, a grip support shaft 44 vertically extending upward from the outer end of the arm portion 43, and a grip 45 rotatably mounted on the grip support shaft 44.

Figure 3:
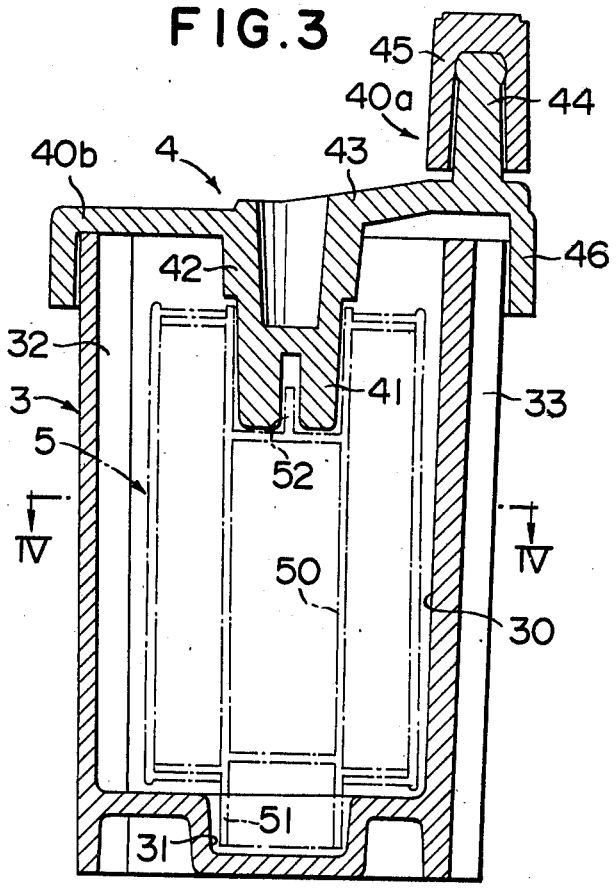
FIG. 3 is a vertical sectional view of another embodiment of the developing device in accordance with the present invention.

As shown in FIG. 3, the cover portion 40*b* of the cover member 4 is provided at the marginal part thereof with an annular portion 46 extending downward and loosely covering the upper end of the tank body 3. The outer end of the arm portion 43 is integrally connected with the annular portion 46. In this specification, the part of the cover member 4 serving as the arm is also referred to as an arm portion.

When the developing device in accordance with the above described second embodiment is used, the film magazine 5 in which the film is fully rolled up on the film wind-back spool 50 is put into the developing tank body 3 in which a developer liquid is contained. The film outlet 53 of the film magazine 5 is inserted in said vertical groove or recess 32 and the downwardly projected end 51 of the spool 50 is received in the recess 31 at the bottom of the tank body 3. Then, the cover member 4 is put on the top of the tank body 3 with the forked portion 41 thereof engaged with the engaging portion 52 of the spool 50. The tank body 3 is held by the left hand and the handle **40*a* is rotated together with the cover portion 40*b*** by the right hand.

In accordance with the above described second embodiment also, it becomes easy to rotate the spool smoothly and accordingly to make the film come into uniform contact with the developer liquid and perform uniform development.

Although in the above described embodiments the developing tank is provided with a cover member, it will be understood that the cover member is not always necessary and the handle can be directly mounted to the spool. Further, the handle need not necessarily be provided with the forked portion. For instance, the handle may be provided with a resilient engaging portion to be resiliently engaged with the spool of the film magazine so that the spool may be rotated by the handle.

We claim:

1. A developing device for developing a photographic film for still cameras, said device comprising a film magazine containing a film wind-back spool on which the film is wound, said film magazine having a film outlet adapted for the passage of the film therethrough and said spool having an end portion which projects downwardly from said magazine, a developing tank body having a cylindrical portion with an open upper end and a bottom portion to receive a developer liquid and the film magazine therein, and a handle which has an engaging portion which releaseably engages said spool, said handle also having an arm portion radially extending outward from said engaging portion to be rotated by the hand so that said spool can be rotated back and forth and thereby effect development of said film by the developer liquid which passes into said magazine, said cylindrical portion of the developing tank being provided on the inner surface thereof with a surface irregularity to be engaged with the film outlet of the film magazine to prevent the film magazine put therein from being rotated therein, said bottom portion of the developing tank being provided at the center thereof with a recess to receive the downwardly projected end of the spool of the film magazine so that the entire bottom portion of said magazine is substantially adjacent to said bottom portion of the developing tank body to thereby optimize the usage of said developer liquid.

2. A developing device as defined in claim 1 wherein said surface irregularity provided on the inner surface of the tank body comprises a plurality of vertically extending protrusions, the radial height thereof being large enough to be engaged with the film outlet of the film magazine.

3. A developing device as defined in claim 1 wherein said surface irregularity provided on the inner surface of the tank body is a vertically extending recess.

4. A developing device as defined in claim 1 wherein said engaging portion of the handle is a forked portion to be engaged with the engaging portion of the spool in the film magazine.

5. A developing device as defined in claim 1 further comprising a cover member which is mounted on the tank body to cover the open upper end of said cylindrical portion and is provided at the center thereof with said handle.

6. A developing device as defined in claim 5 wherein said cover member is fixedly mounted to the upper end of the tank body and said handle is rotatably mounted to the cover member.

7. A developing device as defined in claim 6 wherein said cover member is made of resilient material and is provided at the marginal part thereof with an annular portion extending downward to be resiliently fixed to the outer surface of the upper end portion of said cylindrical portion of the tank body.

8. A developing device as defined in claim 6 wherein said handle is provided at the outer end of the arm portion thereof with a grip support shaft vertically extending upward, and a grip is rotatably mounted on the grip support shaft.

9. A developing device as defined in claim 5 wherein said cover member is loosely mounted on the upper end of the tank body and said handle is fixed to the cover member.

10. A developing device as defined in claim 9 wherein said cover member is provided at the marginal part thereof with an annular portion extending downward to loosely cover the upper end portion of said cylindrical portion of the tank body.

11. A developing device as defined in claim 9 wherein said handle is provided at the outer end of the arm portion thereof with a grip support shaft vertically extending upward, and a grip is rotatably mounted on the grip support shaft.

12. A developing device as defined in claim 9 wherein the outer surface of the cylindrical portion of the tank body is provided with vertically extending protrusions.

13. A developing device as defined in claim 1 wherein the radial length of said handle is about 1.5 to 2.0cm.

* * * * *